US005333685A

United States Patent [19]

Gilbert

[11] Patent Number: 5,333,685

[45] Date of Patent: Aug. 2, 1994

[54] WIRELINE SET AND TUBING RETRIEVABLE PACKER

[76] Inventor: Bruce Gilbert, 5208 Bluridge Ct., Fort Worth, Tex. 76112

[21] Appl. No.: 61,437

[22] Filed: May 14, 1993

[51] Int. Cl.[5] ..... E21B 23/00; E21B 33/00

[52] U.S. Cl. ..... 166/123; 166/134

[58] Field of Search ..... 166/120, 123-125, 166/134, 181, 182, 381, 382, 387

[56] References Cited

U.S. PATENT DOCUMENTS

| | | | |
|---|---|---|---|
| 3,749,166 | 7/1973 | Young | 166/123 |
| 4,479,548 | 10/1984 | Gilbert . | |
| 4,593,765 | 6/1986 | Greenlee . | |
| 4,648,445 | 3/1987 | Caskey . | |
| 4,648,446 | 3/1987 | Fore et al. . | |
| 4,657,078 | 4/1987 | Fraser, III et al. | 166/123 |
| 4,693,309 | 9/1987 | Caskey . | |
| 4,750,564 | 6/1988 | Pettigrew et al. . | |
| 4,796,707 | 1/1989 | Halbardier | 166/123 X |
| 4,832,129 | 5/1989 | Sproul et al. | 166/123 X |
| 5,048,613 | 9/1991 | Shilling . | |
| 5,197,547 | 3/1993 | Morgan . | |

OTHER PUBLICATIONS

Brochure, Arrow Oil Tools, Inc., Tulsa, Oklahoma.

*Primary Examiner*—Thuy M. Bui

*Attorney, Agent, or Firm*—James E. Bradley; Mark W. Handley

[57] ABSTRACT

A retrievable packer is provided for wireline setting and tubing retrieval. A circumferentially extending shear member releases the retrievable packer from the wireline once the retrievable packer is set. A positive locking member releasably locks the upper and lower slips to the mandrel as they are wedged into gripping engagement with the casing string. The positive locking member includes a body lock ring which locks the upper slip assembly in a ratcheting engagement with the packer mandrel, and a J-latch which releasably secures the lower slip assembly to the mandrel.

19 Claims, 4 Drawing Sheets

WIRELINE SET AND TUBING RETRIEVABLE PACKER

BACKGROUND OF THE INVENTION

1. Field of the Invention

The present invention relates generally to downhole well tools of the type used in oil and gas wells and, in particular, to a wireline set and tubing retrievable production packer for use to prevent a fluid flow through a wellbore casing.

2. Description of the Prior Art .

Prior art retrievable packers have been used in oil and gas completion operations for lowering within wellbores on a wireline, and setting within a casing string to prevent a wellbore fluid from flowing between a tubing string and the casing string. Prior art retrievable packers typically include an elastomeric packing means which is compressed to sealingly engage between a sleeve included within the retrievable packer and the interior of a casing string set within the wellbore.

Prior art retrievable packers have been releasably secured to wireline run setting tools by shear pins. However, in slimhole, and other applications, there may not be enough circumferential space between connecting members for placement of sufficient shear pins to provide adequate support for transferring enough setting force to the retrievable packer to urge it into setting engagement within the wellbore.

Additionally, prior art retrievable packers include slip-gripping mechanisms having a set of slip elements which are wedged outwardly until they grippingly engage between a casing string and a retrievable packer to support the retrievable packer at a downhole depth within the wellbore. These prior art slip-gripping mechanisms have been held in place, grippingly engaging the casing, by a ramped surface pressing beneath the slip elements to wedge them laterally outward towards the casing. A coil spring locates between the upper slips and the setting sleeve. Improvements are desired.

SUMMARY OF THE INVENTION

A retrievable packer is provided for setting downhole within a wellbore with a wireline, and for later retrieving from the wellbore with a tubing string. The retrievable packer includes elastomeric packing elements which are compressed to sealingly engaging between a sleeve and a casing string. Upper and lower slip assemblies are provided for wedging into gripping engagement with the casing string to support the retrievable packer within the wellbore. A circumferentially extending shear member is circumferentially severed to release the retrievable packer from the setting tool and the wireline.

The retrievable packer further includes a setting latch and a release latch for releasably locking the retrievable packer into the set position by positively locking both the upper and lower slips to the mandrel as they are wedged into gripping engagement with the casing string. The setting latch is provided by securing a body lock ring within the upper slip assembly for a ratcheting engagement with the packer mandrel. The body lock ring is a longitudinally split ring which has interior buttress threads for ratcheting to engage exterior buttress threads on the packer mandrel. The release latch is provided by laterally extending two pins from a lower end of the packer mandrel, and inserting the two pins into a slotted sleeve coupled to the lower slip assembly.

The two pins may be selectively moved within the slotted sleeve to release the retrievable packer from the set position by manipulation of the mandrel with a tubing string.

The above as well as additional features of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
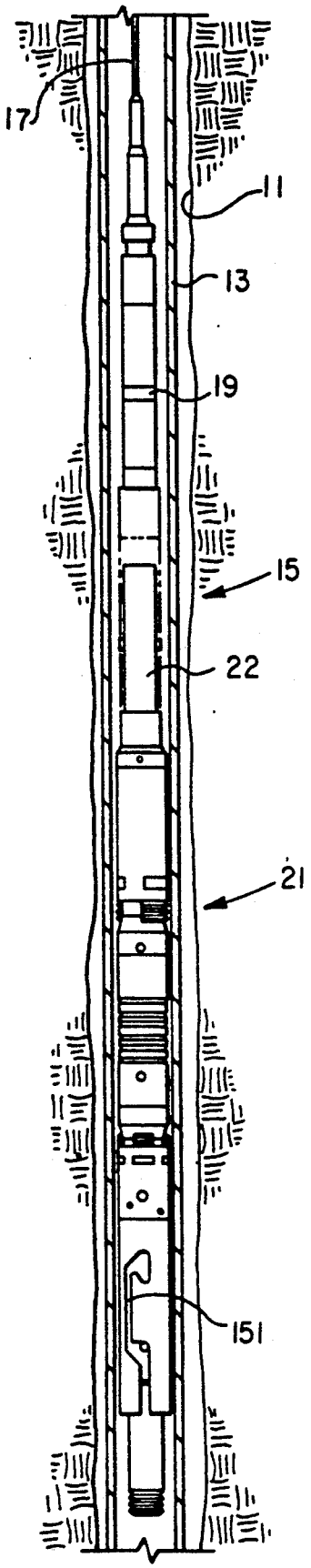
FIG. 1 depicts a partial longitudinal section view of a wellbore and casing string, within which is depicted a perspective view of a wireline tool string that includes a retrievable packer of the present invention, which is shown in an unset position.

With reference now to the figures and in particular with reference to FIG. 1, a partial longitudinal section view depicts wellbore 11 within which is set casing string 13. FIGS. 1 further shows a perspective view of retrievable packer 21 in an unset position, for running into wellbore 11. Wireline tool string 15 is lowered into wellbore 11 suspended by wireline 17. Wireline tool string 15 includes setting tool 19 and retrievable packer 21, which is the preferred embodiment of the present invention. A portion of retrievable packer 21 is shown in phantom, so that the upper end of mandrel 22 may be visible.

Retrievable packer 21 is lowered within wellbore 11 and set to grippingly and sealingly engage casing 13 to prevent a wellbore fluid from flowing therethrough. Retrievable packer 21 may later be retrieved within wellbore 11 by lowering a tubing string (not shown) having an overshot tool (not shown) which couples with mandrel 22. The overshot tool for retrieving retrievable packer 21 can be secured to a tubing string, such as, for example, a production tubing string, a work string, or drill string. Additionally, a blanking plug (not shown) can be secured within retrievable packer 21 for using retrievable packer 21 as a bridge plug.

Setting tool 19 is a wireline setting tool of the type that typically utilizes a flammable solid propellant as a power source for setting packers and bridge plugs within wellbores. In the preferred embodiment of the present invention, setting tool 19 is a Model E-4, number 20 setting tool available from Baker Oil Tools Incorporated, a division of Baker Hughes Incorporated, of Houston, Tex.

Referring now to FIGS. 2*a* through 2*e*, partial longitudinal section views together depict one side of retrievable packer 21, which is shown in an unset position for running into a wellbore. Retrievable packer 21 includes a plurality of tubular members and has longitudinal axis 23. Setting tool mandrel 25 and setting tool sleeve 27 are included within setting tool 19 and threadingly engage with retrievable packer 21. The lower end of setting tool sleeve 27 threadingly engages with the upper end of bushing 29. The lower end of bushing 29 threadingly secures to setting sleeve 33. Setting sleeve 33 includes port 35 for pressure equalization between the interior and exterior of setting sleeve 33.

Figure 3:
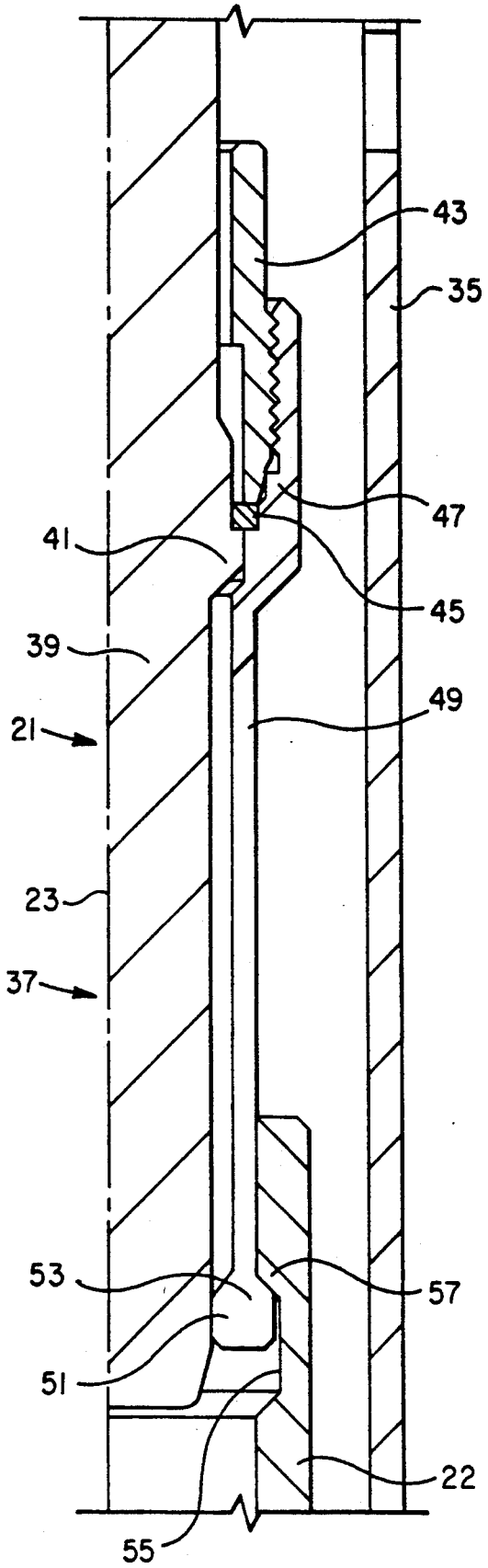
FIG. 3 is a detailed view of a portion of FIG. 2*a* and depicts the setting tool release latch of the present invention.

Retrievable packer 21 further includes collet latch 37, which releasably secures retrievable packer 21 to setting tool 19. Referring to FIG. 3, a detailed view depicts collet latch 37. Collet latch 37 includes collet pin 39, having an upper end which is threadingly coupled to the lower end of setting tool mandrel 25. Collet pin 39 further includes shearing shoulder 41. Shear lock 43 is circumferentially disposed about collet pin 39 and suspended above shearing shoulder 41 by shear member 45. The lower end of shear lock 43 is threadingly secured to the upper end of collet 47.

Shear member 45 circumferentially extends between collet pin 39, shear lock 43, and collet 47 to retain collet pin 39 in place with respect to collet 47. In the preferred embodiment of the present invention, shear member 45 is a solid steel ring which circumferentially separates when 33,000 pounds of longitudinal force is applied.

Collet 47 includes eight longitudinally extending collet fingers 49 which are formed by cutting eight slots into the lower portion of collet 47. Collet heads 51 are formed into the lower end of collet fingers 49 and have collet shoulders 53 for grippingly engaging seating profile 55 at profile upper shoulder 57. Seating profile 55 is turned into the interior of the upper end of upper mandrel 22.

In the preferred embodiment of the present invention, the maximum tensile strength of the eight collet fingers 49 is approximately 76,000 pounds. The maximum bearing load between collet shoulder 53 and profile shoulder 57, in the preferred embodiment of the present invention, is approximately 97,000 pounds. When installed within collet latch 37, shear member 45 in the preferred embodiment of the present invention will shear when exposed to a 33,000 pound shear load.

With reference to FIGS. 2*a* through 2*e*, mandrel 22 includes upper portion 59, from which extend two lugs 61 to provide an on-off tool for mating with a tubing conveyed overshot tool (not shown). Mandrel 22 further includes mandrel coupling 63 and lower portion 65. Central bore 66 extends longitudinally through mandrel 22. The lower end of upper portion 59 of mandrel 22 is threadingly secured to the upper end of mandrel coupling 63. The lower end of mandrel coupling 63 is threadingly secured to the upper end of lower portion 65 of mandrel 22.

Driving sleeve 67 is disposed circumferentially about mandrel coupling 63 and lower portion 65 of mandrel 22. Shear screw 71 is secured to the upper end of driving sleeve 67 for releasably securing driving sleeve 67 to lower portion 65 of mandrel 22 and lower mandrel coupling 63. In the preferred embodiment of the present invention, driving sleeve shear screw 71 is a 5/16ths inch diameter brass shear screw, for shearing at 4,000 pounds force. Shear screw 71 prevents inadvertent setting of retrievable packer 21 as it is being run within wellbore 11.

Figure 4:
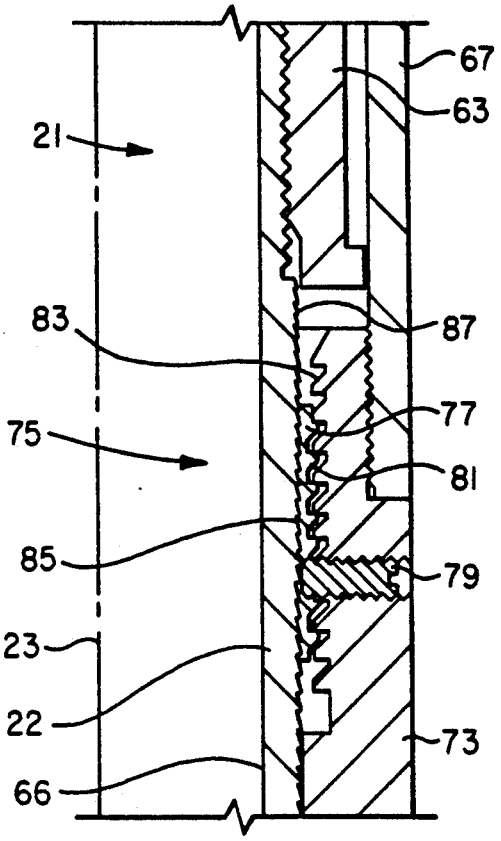
FIG. 4 is a detailed view of a portion of FIG. 2*c* and depicts the setting latch of the present invention.

Referring to FIG. 4, a detailed view depicts setting latch 75. The lower end of driving sleeve 67 is threadingly secured to the upper end of upper slip housing 73. Setting latch 75 is included within upper slip housing 73 and provides a ratchet latch for positively locking slip housing 73 to lower portion 65 of mandrel 22 to prevent slip housing 73 from moving upwards with respect to lower portion 65 of mandrel 22. Setting latch 75 includes body lock ring 77, which is a split ring having large buttress threads 81 about the exterior. Large buttress threads 81 engage large buttress threads 83 which are machined into the interior of upper slip housing 73. In the preferred embodiment of the present invention, buttress threads 81 and 83 are left-handed threads, having six threads per inch. The interior of body lock ring 77 has small buttress threads 85 for a ratcheting engagement with small buttress threads 87 formed into the exterior of the upper end of lower portion 65 of mandrel 22. Small buttress threads 85 and 87 are left-handed threads, having twelve threads per inch.

In the preferred embodiment of the present invention, cap screw 79 secures between body lock ring 77 and upper slip housing 73 to prevent rotation of body lock ring 77 within upper slip housing 73, and to retain body lock ring 77 in a selected position within upper slip housing 73. It should also be noted that although buttress threads are used for threads 81, 83, 85, and 87, other embodiments of the present invention can use another type of profile, such as, for example, a saw tooth thread. Additionally, knurled surface could be utilized to replace buttress threads 85 and 87 providing a friction engagement between mandrel 22 and body lock ring 77.

Body lock ring 77 is split and can expand and contract to ratchet on small buttress threads 84. Body lock ring 77 is sized so that its inner diameter in the natural condition is slightly less than the outer diameter of small buttress threads 87. Further, there is a clearance between large buttress threads 81 and 83 so that body lock ring 77 can expand radially outward for ratcheting between small buttress threads 85 and 87. When installed, body lock ring 77 will thus be inward biased to grip small buttress threads 87. The inclination of the saw tooth shaped small buttress threads 85, 87 allows body lock ring 77 to ratchet and move downward relative to small buttress threads 87, but not upward.

Referring again to FIGS. 2*a* through 2*e*, upper slip assembly 89 includes upper slip housing 73, upper slips 91, and leaf springs 92. Leaf springs 143 urge slips 139 to retract inwardly towards mandrel 22. Upper cone ring 93, and upper ramp surface 95 are formed into the upper end of upper cone ring 93. Ports 97 are circumferentially disposed about and extend laterally through the sidewall of upper cone ring 93. The interior of the lower end of upper cone ring 93 includes shoulder 99 for mating with shoulder 101 of lower portion 65 of mandrel 22 to prevent upward movement of upper cone ring 93 so that upper slips 91 will not be inadvertently set as retrievable packer 21 is run within wellbore 11 (shown in FIG. 1). Additionally, external shoulder 102 of mandrel coupling 63 engages within internal shoulder 100 of driving sleeve 67 for releasing retrievable packer 21 from the set position.

Upper packer retainer 103 includes upper packer ring 104 and upper cone ring 93. Upper packer ring 104 is threadingly secured to the lower end of upper cone ring 93. Sleeve 105 is threadingly secured to the lower end of upper packer retainer 103.

Bypass seal 107 provides a dynamic seal for sealingly engaging between upper packer retainer 103 and lower portion 65 of mandrel 22. Bypass seal 107 is provided to sealingly engage lower portion 65 both prior to setting and during setting of retrievable packer 21. Upper seal retainer 108 and lower seal retainer 109 press bypass seal 107 into sealing engagement between upper packer retainer 107 and lower portion 65. Seal 112 seals between lower seal retainer 109 and upper packer coupling 103. Seal 110 seals between upper packer retainer 103 and sleeve 105.

Bypass equalizing clearance 111 is machined into the exterior of lower portion 65 of mandrel 22. Bypass equalizing clearance 111 is provided so that bypass seal 107 may be moved within bypass equalizing clearance 111, and bypass flowpath 113 will be opened for passing wellbore fluids therethrough as retrievable packer 21 is being released from a setting position. Wellbore fluids are passed through bypass flowpath 113 to equalize pressure across retrievable packer 21 prior to releasing retrievable packer 21 from setting engagement within casing 13, during retrieving of retrievable packer 21 from wellbore 11. Ports 115 are spaced circumferentially about and extend laterally through sleeve 105.

Packing means 117 extends circumferentially about sleeve 105, and includes upper packing element 119, central packing element 121, lower packing element 123. Spacers 125 are disposed between upper packing element 119 and central packing element 121, and between lower packing element 123 and central packing element 121.

Lower packer retainer 129 includes lower packer ring 131 and lower cone ring 133. Lower packer ring 131 is threadingly secured to the upper end of lower cone ring 133. Lower packer retainer 129 is slidably engaged about sleeve 105, with shoulder 132 positioning packer means 119, 121, and 123 on the sleeve 105.

Lower slip assembly 137 includes the lower slips 139, lower slip housing 141, and leaf springs 142. Lower cone ring 133, and lower ramp surface 135 are formed into the upper end of upper cone ring 93. Leaf springs 142 urge slip 139 to retract inwardly towards mandrel 22. Shear pin 143 extends laterally between sleeve 105 and lower slip housing 141 to prevent upward movement of lower slip housing 141 so that lower slips 139 will not be inadvertently set as retrievable packer 21 is run within wellbore 11. J-slot sleeve 149 is threadingly secured to the lower end of lower slip housing 141.

Ring 145 is threadingly secured to the lower end of sleeve 105.

Figure 2A:
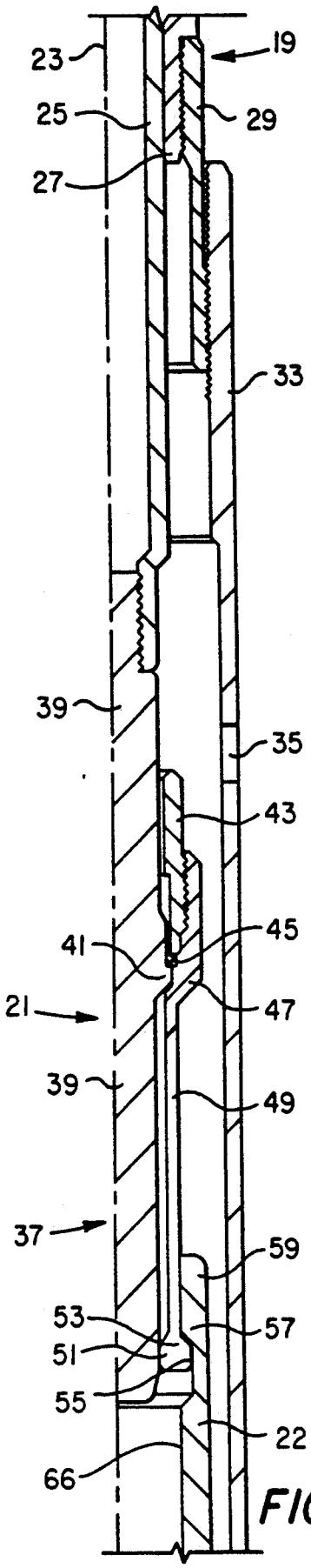
FIGS. 2*a* through 2*e* are partial longitudinal section views which together depict one side of the retrievable packer of the present invention, which is shown in an unset position for running into the wellbore.
Figure 2B:
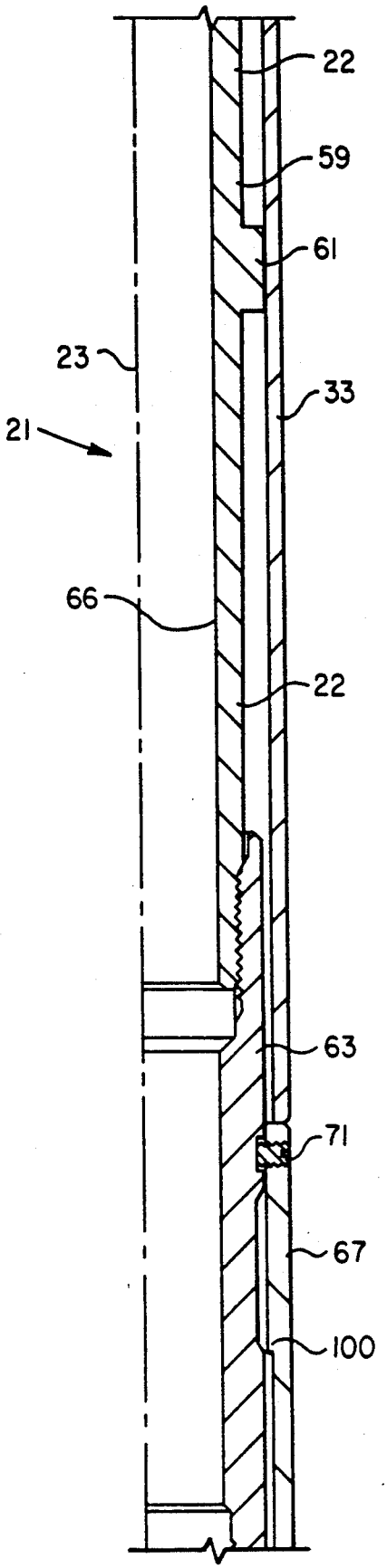
Figure 2C:
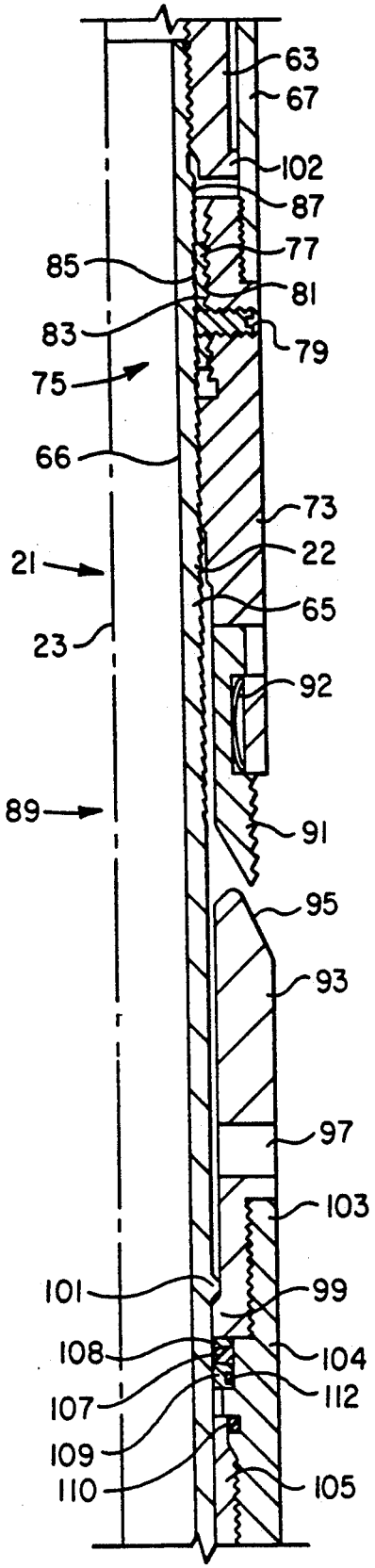
Figure 2D:
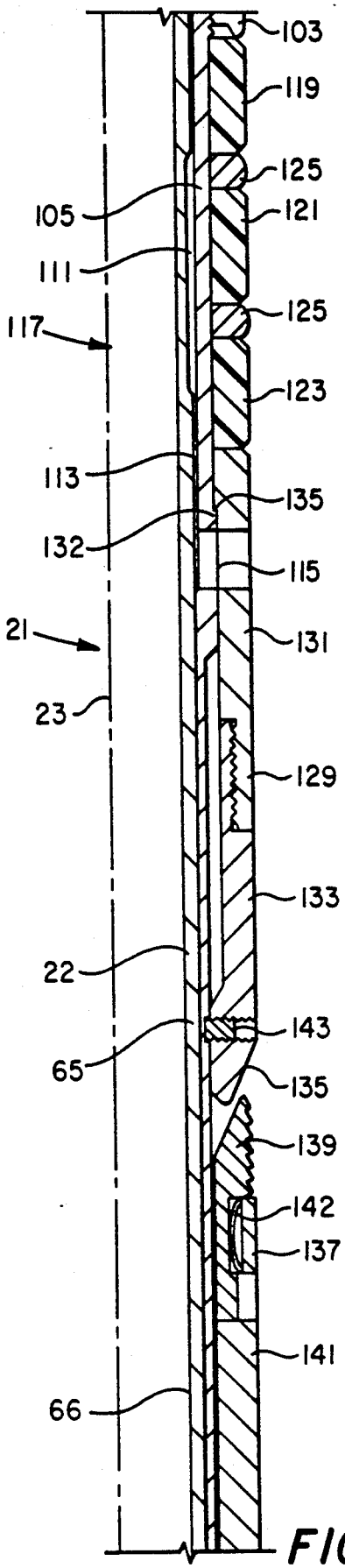
Figure 2E:
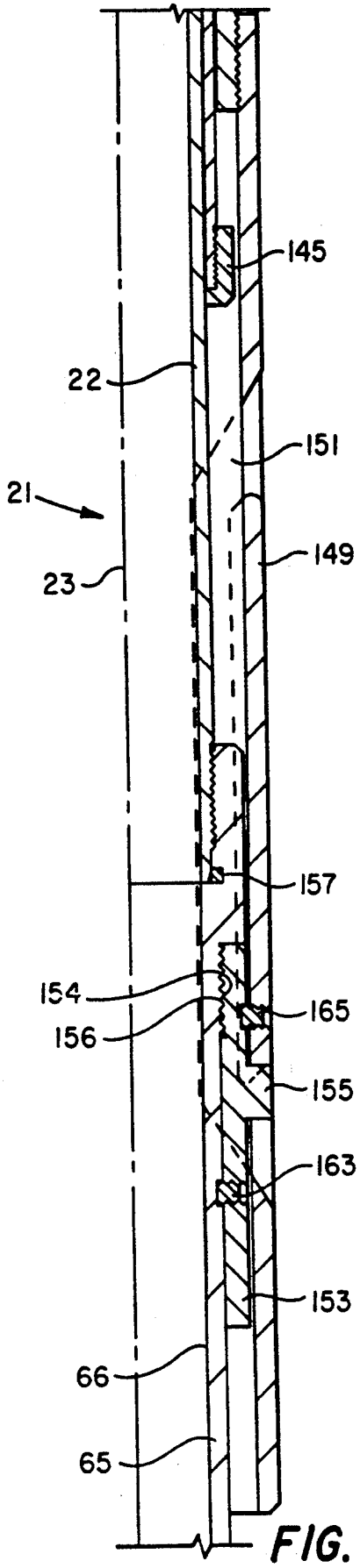

Release latch 147 is a J-latch which is included within the lower end of retrievable packer 21, and includes J-slot sleeve 149 and J-pin body 153. J-slot sleeve 149 is secured to the lower end of the packing element. J-slots 151 (shown in phantom in FIGS. 2*a* and 2*e*, shown in a perspective view in FIG. 1) are machined into the lower end of J-slot sleeve 149.

J-pin body 153 is secured to the lower end of mandrel 22 by left hand threads 154 and 156. J-pin body 153 includes J-latch pins 155 which are slidably engagable within J-slots 151. Seal 157 is provided for sealingly engaging between lower portion 65 of mandrel 22 and J-pin body 153 to prevent wellbore fluids from flowing therebetween. Threads 159 are provided in the interior of J-pin body 153 for securing additional tubing members (not shown) below retrievable packer 21. It should also be noted that in the other embodiments of the present invention, a blanking plug could be secured at threads 159 for using retrievable packer 21 as a bridge plug.

Shear pin 163 extends laterally between J-pin body 153 and mandrel 22 for releasably securing J-pin body 153 to mandrel 22. Shear pin 163 provides an emergency release for moving retrievable packer 21 to a released position if J-latch pins 155 can not be moved within J-slots 151, such as if debris becomes lodged within J-slot sleeve 149. If J-latch pins 155 cannot be moved within J-slots 151, mandrel 22 can be torqued to sever shear pin 163, and then mandrel 22 can be rotated to the right to unscrew mandrel 22 from J-pin body 153 and release retrievable packer 21.

Shear pin 165 extends between J-pin body 153 and J-slot sleeve 149 so that J-latch pins 155 will not be inadvertently released as retrievable packer 21 is being run within wellbore 11. Shear pin 165 severs when a predetermined level of torque is applied for rotating J-latch pins 155 within J-slot sleeve 149.

Operation of retrievable packer 21 is now described. With reference to 1*a* and 1*b*, retrievable packer 21 is shown in an unset position as it is being lowered within casing string 13 secured to wireline 17 and setting tool 19. Once retrievable packer 21 is lowered to a selectable position within casing string 13, setting tool 19 is actuated and, referring to FIGS. 2*a*–2*e*, setting tool sleeve 27 is thrust downward with respect to setting tool lower mandrel 25. Setting tool lower mandrel 25 is secured to mandrel 22 and the lower end of J-slot sleeve 149, and holds the packing sleeves in position, while setting tool sleeve 27 urges setting sleeve 33 downward. Setting sleeve 33 urges driving sleeve 67 downward, shearing driving sleeve shear screw 71 once 4,000 pounds of force is applied by setting tool 19 (shown in FIG. 1). Still referring to FIGS. 2*a* through 2*e*, driving sleeve shear screw 71 severs, and driving sleeve 67 is urged downward, which urges upper slip housing 73 downward.

Downward movement of upper slip housing 73 causes setting latch 75 to operate. Upper slip housing 73 urges body lock ring 77 downward, causing threads 85 to ratchetingly engage thread 87 in lower portion 65 of mandrel 22.

Threads 81 and 83 are stationery, and prevented from relative rotational movement by cap screw 79. Threads 81 and 83 will not ratchet. However, threads 81 and 83 have clearances to allow the body lock ring 77 to extend outward slightly so that threads 85 and 87 may ratchet to allow upper slip housing 73 to move downward with respect to lower portion 65 of mandrel 22. However, threads 85 and 87 prevent upper slip housing 73 from moving upward with respect to lower portion 65 of mandrel 22.

Ratchet latch 75 prevents upper slip housing 73 from moving upward with respect to lower portion 65 of mandrel 22. Downward movement of upper slip housing 73 causes upper slips 91 to engage ramp surface 95 of upper cone ring 93. Engagement of upper slips 91 with the ramped surfaces of upper cone ring 93 both urges upper cone ring 93 downward, and urges upper slips 91 radially outward to grippingly engage casing 13 (shown in FIG. 1), with cone ring 93 wedging slips 91 outward.

Still referring to FIGS. 2*a* through 2*e*, downward movement of upper cone ring 93 urges upper packer retainer 103 downward, and compresses packing means 117 to urge them to sealingly engage between sleeve 105 and the interior surface of casing string 13 to prevent wellbore fluid from flowing therethrough. Packing means 117 presses downward on lower retainer 129 to urge lower ramp surface 135 of lower case ring 133 to press lower slips 139 outward to grippingly engage casing string 13.

During setting, J-latch pin 155 remains at the lower end of J-slot 151 to couple lower portion 65 of mandrel 22 and setting tool lower mandrel 25 to J-slot sleeve 149, holding the lower end of the packing element stationery with respect to setting tool lower mandrel 25, until setting tool sleeve 27 forces upper packer retainer 103 downward and compresses the packing elements.

When retrievable packer 21 is in the set position, (not shown), packing means 117 will sealingly engage between the interior casing 13 and the exterior surface of sleeve 105. Bypass seal 107 will sealingly engage between sleeve 105 and lower portion 65 of mandrel 22, in a position above bypass equalizing clearance 111, yet below that position in which bypass seal 107 is shown in FIGS. *2a* through *2e*. Bypass seal 107 and seal 110 will prevent fluid flow through bypass flowpath 113. Seal 157 will prevent fluid flow between J-pin body 153 and lower portion 65 of mandrel 22. Thus, retrievable packer 121 in a setting position seals between lower portion 65 of mandrel 22 and the interior of wellbore casing 13. It should be noted that in the preferred embodiment of the present invention, mandrel 22 is imperforate; that is, it does not include any fluid flow ports through the wall.

When retrievable packer 21 has been urged into setting engagement within casing string 13, collet latch 37 operates to release setting tool 19 (shown in FIG. 1) from retrievable packer 21.

When 33,000 pounds shear force is exerted across retrievable packer 21 by setting tool lower mandrel 25 and setting tool sleeve 27, shear lock 43 will be urged downward as shear member 45 is held in place by shearing shoulder 41. When 33,000 pounds of force is applied between shear lock 43 and shear ring shoulder 41, shear member 45 will be circumferentially severed and setting sleeve 33 will push downward against J-slot sleeve 149 to urge mandrel 22 downward. Mandrel 22 is urged downward, and profile upper shoulder 57 will push against collet shoulders 53 and urge collet 47 downward. With shear member 45 severed, collet 47 will move downward with respect to collet pin 39 until an interior shoulder of shear lock 43 will engage shearing shoulder 41, at which position collet heads 51 will have passed below collet pin 39. Collet heads 51 will then be urged inward and out of seating profile 55, releasing mandrel 22 from collet latch 57. Then setting tool 19 may be removed from wellbore 11 along with collet pin 39, shear lock 43, collet 47, bushing 29, and setting sleeve 33. Mandrel 22 and driving sleeve 67 will remain within wellbore 11 with retrievable packer 21.

Retrieval of retrievable packer 21 from wellbore 11 is now described, with reference to FIG. 1, and *2a*, through *2e*, which depict retrievable packer 21 in an unset, or running position. A tubing string (not shown) may be run within wellbore 11 and coupled to connector retrieving head 22.

An overshot tool (not shown) may be engaged with lugs 61 on mandrel 22 to secure the tubing string (not shown) for transmission of the torque and longitudinal force to packer 21. Torque and longitudinal force applied to mandrel 22 is passed through upper portion 59 of mandrel 22, through mandrel coupling 63 to lower portion 65 of mandrel 22 for operation of J-latch 147. J-latch 147 may be operated by applying torque in excess of that required to sever shear member 165, which urges J-latch pins 155 to rotate within J-slots 151. Then, application of right hand rotation to mandrel 22 releases the J-latch 147 from the set position to allow movement of J-latch pin 155 upwards within J-slots 151 to the upper end of J-slots 151.

This frees mandrel 22 to move relative to sleeve 105, allowing bypass equalizing clearance 111 to move adjacent to bypass seal 107 for opening bypass fluid flowpath 113 to allow fluid flow through bypass flowpath 113 to equalize fluid pressure across packing means 117 prior to releasing upper slips 91 and lower slips 139 from gripping engagement with casing 13. It should also be noted that since bypass ports 97 are below upper slips 91, wellbore fluid flowing upward through bypass 113 will pass around upper slips 91, for removing debris that may become lodged around upper slips 91 while retrievable packer 21 is in the setting position.

With mandrel 22 free to rotate and slide upward with respect to sleeve 105, the tubing may be pulled upward, possibly bumped, to release packing means 117 and free upper slips 91 and lower slips 139 from gripping engagement with casing 13. Leaf springs 92 and 142 beneath upper slips 91 and lower slips 139 will urge slips 91 and 139 inward. It should be noted that setting latch 75 which allows movement of sleeve 105 downward with respect to mandrel 22 will not allow movement of mandrel 22 upwards with respect to 105. J-latch 147 is released by moving J-latch pins 155 from the latched position as shown in FIG. *2e*, to the upper end of J-slots 151 (J-latch pin 155 not shown in the unlatched position). With slips 91 and 139 retracted, and packing means 117 uncompressed, retrievable packer 21 may then be removed from wellbore 11.

Thus, as discussed above, retrievable packer 21 may be run within a wellbore on wireline, used as a production packer, or for other completion operations, and later removed from the wellbore with a tubing string, or other tubular workstring. A seal assembly may be run within packer 21 for sealingly engaging the interior of mandrel 22, or another tubular member which may be coupled beneath retrievable packer 21 by connection to interior threads 159 in the lower end of J-pin body 153.

The present invention has several advantages over prior art retrievable packers. First, the retrievable packer of the present invention does not include a spring for urging the upper slips to grippingly engage a casing string. Rather, the retrievable packer of the present invention directly presses the upper slips to grippingly engage a casing string with a solid member.

Further, the present invention includes a setting latch which provides a positive locking engagement between the upper slip housing and the mandrel. A body lock ring includes buttress threads which extend laterally from the body lock ring and laterally across mating buttress threads formed on the mandrel to provide a positive locking engagement. The mating buttress threads of the body lock ring and the mandrel buttress one another to prevent movement between said mandrel and said slip housing in one longitudinal direction within said retrievable packer.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A retrievable packer for releasably securing to a setting tool in an unset position, running into a wellbore on a wireline and urging into a set position within a casing string, and securing to a tubing string and urging into a released position for retrieval from said wellbore, said retrievable packer comprising:

a mandrel having a tubular body and a central bore extending longitudinally therethrough;

a means for securing said mandrel to said tubing string;

a sleeve concentrically disposed about and slidably moveable in a longitudinal direction along said mandrel;

a packing means which extends concentrically about an exterior of said sleeve for urging to sealingly engage between said sleeve and said casing string when said retrievable packer is in said set position;

at least one slip assembly for urging to grippingly engage said casing string to secure said retrievable packer within said wellbore at said downhole position, said at least one slip assembly including a plurality of slips and a slip housing;

at least one ramped exterior surface for engaging said ramped inner surfaces of said slips and wedging between said mandrel and said slips for urging said slips radially outward to grippingly engage said casing string when said retrievable packer is urged into said set position.

a plurality of surfaces adjacent to said packing means for, when said retrievable packer is urged into said set position, pressing against said packing means to urge said packing means to sealingly engage between said casing string and said sleeve for preventing a wellbore fluid from flowing therethrough;

a setting sleeve concentrically coupled to said setting tool, and releasably disposed about said mandrel for transferring a setting force from said setting tool to said retrievable packer for urging said retrievable packer into said set position, in which said retrievable packer grippingly and sealingly engages said casing string;

a positive locking means carried about said mandrel for positively locking said slip housing against upward movement relative to said mandrel while said setting sleeve is urging said retrievable packer to said set position;

a packer release latch carried about said mandrel for releasably securing said mandrel to said at least one slip assembly; and a sealing means for sealing between said sleeve and said mandrel to prevent a wellbore fluid from passing therethrough when said retrievable packer is in said set position.

2. The retrievable packer of claim 1, wherein said positive locking means comprises:

a gripping means on said mandrel for providing a gripping surface; and a body lock ring which is a split ring coupled to said slip housing to engage said gripping means on said mandrel when said slip housing is urged upward relative to said mandrel, and which releases said gripping means when said mandrel tends to move upward relative to said slip housing.

3. The retrievable packer of claim 2, wherein said gripping means is a roughened surface on the exterior of said mandrel, and said roughened surface is gripped by said body lock ring as said slip housing is urged upward relative to said mandrel to prevent said slip housing from moving relative to said housing.

4. The retrievable packer of claim 3, wherein said roughened surface is a set of grooves.

5. The retrievable packer of claim 2, wherein said positive locking means further comprises:

an inner buttress thread on said slip housing;

said body lock ring including an exterior buttress thread for engaging said inner buttress thread to prevent movement of said body lock ring relative to said slip housing;

said inner buttress thread disposed for pressing against said exterior buttress thread to urge said body lock ring to move laterally inward to press said body lock ring toward said gripping means on said mandrel when said slip housing tends to move upward relative to said mandrel; and said inner and exterior buttress threads having a clearance between them to accommodate a radial expansion of said body lock ring as said body lock ring moves over said gripping means while the slip housing is moved downward relative to the mandrel.

6. The retrievable packer of claim 1, wherein said positive locking means further comprises:

an outer grooved surface formed on said mandrel;

an inner profile on an inner surface of said slip housing;

a body lock ring which is a split ring having an exterior profile for engaging against said inner profile to prevent longitudinal movement of said body lock ring relative to said slip housing, said body lock ring having an interior grooved surface for engaging said outer grooved surface on said mandrel;

said inner profile disposed for pressing against said exterior profile to urge said body lock ring to move laterally inward to press said interior grooved surface of said body lock ring toward said outer grooved surface of said mandrel to prevent relative movement therebetween when said slip housing tends to move upward relative to said mandrel; and said inner and exterior profiles having clearances therebetween to allow said interior grooved surface of said body lock ring to ratchet on said outer grooved surface of said mandrel when said upper slip housing is moved downward relative to said mandrel.

7. The retrievable packer of claim 1, wherein said positive locking means comprises:

an outer buttress thread formed on said mandrel;

an inner buttress thread on an inner surface of said slip housing;

a body lock ring which is a split ring having an exterior buttress thread for engaging against said inner buttress thread to prevent longitudinal movement of said body lock ring relative to said slip housing, said body lock ring having an interior grooved surface for engaging said outer grooved surface on said mandrel; and said inner buttress disposed for pressing against said exterior buttress to urge said body lock ring to move laterally inward to press said interior grooved surface of said body lock ring toward said outer grooved surface of said mandrel to prevent relative movement therebetween when said slip housing tends to move upward relative to said mandrel; and said inner and exterior buttress having clearances therebetween to allow said interior grooved surface of said body lock ring to ratchet on said outer grooved surface of said mandrel when said upper slip housing is moved downward relative to said mandrel.

8. The retrievable packer of claim 1, wherein said setting tool release latch comprises:

said mandrel further having a profile which extends into said central bore to define a singular groove;

a collet pin having a longitudinally extending body which is coupled on an upper end to a wireline setting tool, a second end which extends downward into said retrievable packer, and a collet pin profile which extends circumferentially around said collet pin body;

a collet which extends circumferentially around an exterior of said collet pin, and includes a collet profile which extends circumferentially around said collet;

said collet having a plurality of longitudinally extending collet fingers from which extend a plurality of collet heads, each of said collet fingers including only one collet head which engages in said singular groove formed into said mandrel;

a shearable member which circumferentially extends between said collet pin and said collet in an annular space formed, at least in part, by said collet pin profile and said collet profile; and said shearable member shearably connecting said collet to said collet pin for retaining said second end of said collet pin adjacent to said collet heads to retain each of said collet heads within said singular groove for shearably connecting said retrievable packer to said wireline setting tool for running into said wellbore to a downhole setting depth, and said shearable member circumferentially separating to release said retrievable packer from said wireline setting tool when a predetermined force is applied thereacross.

9. A retrievable packer for releasably securing to a setting tool in an unset position, lowering into a downhole position within a wellbore with a wireline, urging into a set position to grippingly and sealingly engage a casing string at said downhole position, releasing from said setting tool for removal of said setting tool and said wireline from said wellbore, and selectively releasing from grippingly and sealingly engaging said casing string for retrieval from said wellbore, said retrievable packer comprising:

a mandrel having a tubular body and a central bore extending longitudinally therethrough, and a profile which extends into said central bore to provide a singular groove which includes an upper shoulder;

a means for securing said mandrel to said tubing string;

a sleeve concentrically disposed about and slidably moveable in a longitudinal direction along said mandrel;

a packing means;

at least one slip assembly for urging to grippingly engage said casing string to secure said retrievable packer within said wellbore at said downhole position, said slip assembly including a plurality of slips, and a slip housing;

said plurality of slips exteriorly extending longitudinally along said mandrel, each of said plurality of slips having a ramped inner surface and a serrated exterior surface for urging said slips to grippingly engage said casing string;

said slip housing concentrically disposed about said mandrel for movably securing said plurality of slips about said mandrel, said slip housings including a plurality of bias members therein for urging said plurality of slips to move radially inward toward said mandrel when said retrievable packer is disposed in said unset and said released positions;

at least one ramped exterior surface for engaging said ramped inner surfaces of said slips and wedging between said mandrel and said slips for urging said slips radially outward to grippingly engage said casing string when said retrievable packer is urged into said set position;

a plurality of surfaces adjacent to said packing means for, when said retrievable packer is urged into said set position, pressing against said packing means to squeeze said packing means into sealingly engage between said casing string and said sleeve to prevent a wellbore fluid from flowing therethrough;

a setting sleeve concentrically coupled to said setting tool, and releasably disposed about said mandrel;

a drive sleeve concentrically disposed about said mandrel between said setting sleeve and said slip housing, said drive sleeve having a first end for receipt of said setting force from said setting tool, and a second end for transferring said setting force to said slip housing, and said packing means;

a packer release latch for releasably securing said at least one slip assembly to said mandrel;

a sealing means for sealing between said sleeve and said mandrel to prevent said wellbore fluid from passing therethrough when said retrievable packer is in said set position;

a collet pin having a longitudinally extending body which is coupled on an upper end to a wireline setting tool, a second end which extends downward into said retrievable packer, and a collet pin profile which extends circumferentially around said collet pin body;

a collet which extends circumferentially around an exterior of said collet pin, and includes a collet profile which extends circumferentially around said collet;

said collet having a plurality of longitudinally extending collet fingers from which extend a plurality of collet heads, each of said collet fingers including only one collet head which engages in said singular groove of said mandrel;

a shearable member which circumferentially extends between said collet pin and said collet in an annular space formed, at least in part, by said collet pin profile and said collet profile; and said shearable member shearably connecting said collet to said collet pin for retaining said second end of said collet pin adjacent to said collet heads to retain each of said collet heads within said singular groove for shearably connecting said retrievable packer to said wireline setting tool for running into said wellbore to a downhole setting depth, and said shearable member circumferentially separating to release said retrievable packer from said wireline setting tool when a predetermined force is applied thereacross.

10. The retrievable packer of claim 9, further including a positive locking means which comprises:

a gripping means on said mandrel for providing a gripping surface; and a body lock ring which is a split ring coupled to said slip housing to engage said gripping means on said mandrel when said slip housing is urged upward relative to said mandrel, and which releases said gripping means when said mandrel tends to move upward relative to said slip housing.

11. The retrievable packer of claim 10, wherein said gripping means is a toughened surface on the exterior of said mandrel, and said roughened surface is gripped by said body lock ring as said slip housing tends to move upward relative to said mandrel to prevent said slip housing from moving relative to said housing.

12. The retrievable packer of claim 10, wherein said positive locking means further comprises:

an inner buttress thread on said slip housing;

said body lock ring including an exterior buttress thread for engaging said inner buttress thread to prevent movement of said body lock ring relative to said slip housing;

said inner buttress thread disposed for pressing against said exterior buttress thread to urge said body lock ring to move laterally inward to press said body lock ring toward said gripping means on said mandrel when said slip housing tends to move upward relative to said mandrel; and said inner and exterior buttress threads having a clearance between them to accommodate a radial expansion of said body lock ring as said body lock ring moves over said gripping means while the slip housing is moved downward relative to the mandrel.

13. The retrievable packer of claim 9, wherein said positive locking means further comprises:

an outer grooved surface formed on said mandrel;

an inner profile on an inner surface of said slip housing;

a body lock ring which is a split ring having an exterior profile for engaging against said inner profile to prevent movement of said body lock ring relative to said slip housing, said body lock ring having an interior grooved surface for engaging said outer grooved surface on said mandrel;

said inner profile disposed for pressing against said exterior profile to urge said body lock ring to move laterally inward to press said interior grooved surface of said body lock ring toward said outer grooved surface of said mandrel to prevent relative movement therebetween when said slip housing tends to move upward relative to said mandrel; and said inner and exterior profiles having clearances therebetween to allow said interior grooved surface of said body lock ring to ratchet on said outer grooved surface of said mandrel when said upper slip housing is moved downward relative to said mandrel.

14. The retrievable packer of claim 9, wherein said positive locking means comprises:

an outer buttress thread formed on said mandrel;

an inner buttress thread on an inner surface of said slip housing;

a body lock ring which is a split ring having an exterior buttress thread for engaging against said inner buttress thread to prevent movement of said body lock ring relative to said slip housing, said body lock ring having an interior grooved surface for engaging said outer grooved surface on said mandrel; and said inner buttress disposed for pressing against said exterior buttress to urge said body lock ring to move laterally inward to press said interior grooved surface of said body lock ring toward said outer grooved surface of said mandrel to prevent relative movement therebetween when said slip housing tends to move upward relative to said mandrel; and said inner and exterior buttress having clearances therebetween to allow said interior grooved surface of said body lock ring to ratchet on said outer grooved surface of said mandrel when said upper slip housing is moved downward relative to said mandrel.

15. In a retrievable packer of the kind having a mandrel through which a central bore longitudinally extends in an upward and a downward direction, a sealing means extending circumferentially about an exterior of said mandrel for pushing downward along said mandrel to sealingly engage between said mandrel and a casing string, at least one slip assembly for urging downward to engage a ramped surface which wedges therebeneath to outwardly urge said at least one slip assembly to grippingly engage said casing string, and a release latch for releasing said mandrel to move upward to release said gripping means from grippingly engaging said casing string and to release said sealing means from sealingly engaging between said mandrel and said casing string, an improvement comprising:

an outer grooved surface on said mandrel;

an inner profile on said slip housing;

a body lock ring which is a split ring having an exterior profile for engaging against said inner profile to prevent movement of said body lock ring relative to said slip housing, said body lock ring having an interior grooved surface for engaging said outer grooved surface of said mandrel;

said inner profile disposed for pressing against said exterior profile to urge said body lock ring to move laterally inward to press said interior grooved surface of said body lock ring toward said outer grooved surface of said mandrel to engage said mandrel to prevent relative movement therebetween when said slip housing is urged upward relative to said mandrel; and said inner and exterior profiles having clearances therebetween to allow said interior grooved surface of said body lock ring to ratchet on said outer grooved surface of said mandrel when said slip housing is moved downward relative to said mandrel.

16. The improvement of claim 15, wherein said inner profile of said slip housing is an inner buttress thread and said exterior profile of said body lock ring is an exterior buttress thread.

17. The improvement of claim 16, wherein said interior grooved surface of said body lock ring and said outer grooved surface of said mandrel are buttress threads.

18. The improvement of claim 15, wherein said interior grooved surface of said body lock ring and said outer grooved surface of said mandrel are buttress threads.

19. The improvement of claim 15, further including a setting tool release latch which comprises:

said mandrel having a profile which extends into said central bore to define a singular groove;

a collet pin having a longitudinally extending body which is coupled on an upper end to a wireline setting tool, a second end which extends downward into said retrievable packer, and a collet pin profile which extends circumferentially around said collet pin body;

a collet which extends circumferentially around an exterior of said collet pin, and includes a collet profile which extends circumferentially around said collet;

said collet having a plurality of longitudinally extending collet fingers from which extend a plurality of collet heads, each of said collet fingers including only one collet head which engages in said singular groove of said mandrel;

a shearable member which circumferentially extends between said collet pin and said collet in an annular space formed, at least in part, by said collet pin profile and said collet profile; and said shearable member shearably connecting said collet to said collet pin for retaining said second end of said collet pin adjacent to said collet heads to retain each of said collet heads within said singular groove for shearably connecting said retrievable packer to said wireline setting tool for running into said wellbore to a downhole setting depth, and said shearable member circumferentially separating to release said retrievable packer from said wireline setting tool when a predetermined force is applied thereacross.

* * * * *